US011723843B2

(12) United States Patent
Yarto

(10) Patent No.: US 11,723,843 B2
(45) Date of Patent: Aug. 15, 2023

(54) PILL REMINDER MECHANISM

(71) Applicant: Shari Yarto, Dallas, TX (US)

(72) Inventor: Shari Yarto, Dallas, TX (US)

( * ) Notice: Subject to any disclaimer, the term of this patent is extended or adjusted under 35 U.S.C. 154(b) by 0 days.

(21) Appl. No.: 17/335,197

(22) Filed: Jun. 1, 2021

(65) Prior Publication Data

US 2022/0378660 A1 Dec. 1, 2022

(51) Int. Cl.
*A61J 7/02* (2006.01)
*A61J 7/04* (2006.01)

(52) U.S. Cl.
CPC ..... *A61J 7/02* (2013.01); *A61J 7/0427* (2015.05)

(58) Field of Classification Search
CPC .... A61J 7/02; A61J 7/0427; A61J 7/04; G09F 11/04
USPC ..... 221/2
See application file for complete search history.

(56) References Cited

U.S. PATENT DOCUMENTS 2,833,028 A * 5/1958 Treimann ..... A47F 1/06 29/814
3,227,127 A * 1/1966 Gayle ..... A61J 7/04 206/533
3,454,152 A * 7/1969 Vanderhyde ..... B65D 83/0454 206/533
4,041,628 A * 8/1977 Sasson ..... G09D 3/06 116/308
4,572,376 A * 2/1986 Wrennall ..... A61J 7/04 220/253
5,319,872 A * 6/1994 Bammate ..... F42B 39/00 224/663
5,337,897 A * 8/1994 Yablans ..... B65D 83/0858 206/823
5,577,335 A * 11/1996 Tucker ..... A47B 23/044 215/230
6,000,589 A * 12/1999 Burdine ..... F41A 9/65 224/931
6,098,835 A * 8/2000 DeJonge ..... B65D 83/0463 221/25
7,222,736 B1 * 5/2007 Seijas ..... A61J 7/04 116/318
7,555,995 B1 * 7/2009 Stump ..... A61J 7/04 116/318
7,661,384 B2 * 2/2010 Mataya ..... A61J 1/1425 116/307
8,302,783 B1 * 11/2012 Harris ..... A47F 1/06 211/59.3
8,763,553 B1 * 7/2014 Shannehan ..... A61J 7/04 116/308
9,459,062 B2 * 10/2016 Shaskan ..... F42B 39/02
9,738,433 B2 * 8/2017 Hogg ..... H01M 50/264
10,213,365 B1 * 2/2019 Sukkarieh ..... A61J 7/0076
11,116,698 B2 * 9/2021 Brady ..... G16H 20/13
2007/0056503 A1 * 3/2007 Sollaccio ..... G09F 11/23 116/308
2007/0187282 A1 * 8/2007 Seijas ..... A61J 7/04 116/318
2009/0178609 A1 * 7/2009 Kreshek ..... G09F 11/23 116/308

(Continued)

*Primary Examiner* — Rakesh Kumar
(74) *Attorney, Agent, or Firm* — Akona IP

(57) ABSTRACT

A pill reminder mechanism including a reminder mechanism and a strap detachably coupled to the reminder mechanism. The reminder mechanism may include a strap base, an hour wheel, an hour face, a day wheel, a center hub, and a faceplate.

3 Claims, 10 Drawing Sheets

(56) References Cited

U.S. PATENT DOCUMENTS

| | | | | |
|---|---|---|---|---|
| 2010/0294692 | A1* | 11/2010 | Gelardi | B65D 83/0445 206/468 |
| 2010/0327006 | A1* | 12/2010 | Campo | F41A 9/82 221/185 |
| 2011/0067623 | A1* | 3/2011 | Fagan | G09F 11/23 235/494 |
| 2015/0078139 | A1* | 3/2015 | Raiti de Boyles | A61J 7/04 368/10 |

* cited by examiner

PILL REMINDER MECHANISM

FIELD OF THE INVENTION

The present invention relates to pill tracking systems and, more specifically, to pill tracking systems that attach to pill bottles.

BACKGROUND

Medicine is a critical daily support element for many people. Many types of medicine are increasingly effective, and sometimes only effective, if taken precisely at times laid out in a prescription. With some medicine, the prescription can even specify (multiple) times of day.

These requirements can be true for other daily intakes such as, but not limited to, vitamins, supplements, nutrients, and over-the-counter medicine. Reminder mechanisms can be helpful, however, the reminder mechanism can be hard to keep track of. If misplaced, the reminder mechanism loses all effect.

SUMMARY OF THE INVENTION

The present invention comprises a pill reminder mechanism including a reminder mechanism and a strap detachably coupled to the reminder mechanism. The reminder mechanism may include a strap base, an hour wheel, an hour face, a day wheel, a center hub, and a faceplate.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context clearly indicates otherwise. It will be further understood that the terms "comprises" and "comprising", when used in this specification, specify the presence of stated features, steps, operations, elements, and components, but do not preclude the presence or addition of one or more other features, steps, operations, elements, components, or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present disclosure is to be considered as an exemplification of the invention, and is not intended to limit the invention to the specific embodiments illustrated by the figures or description below.

Figure 1:
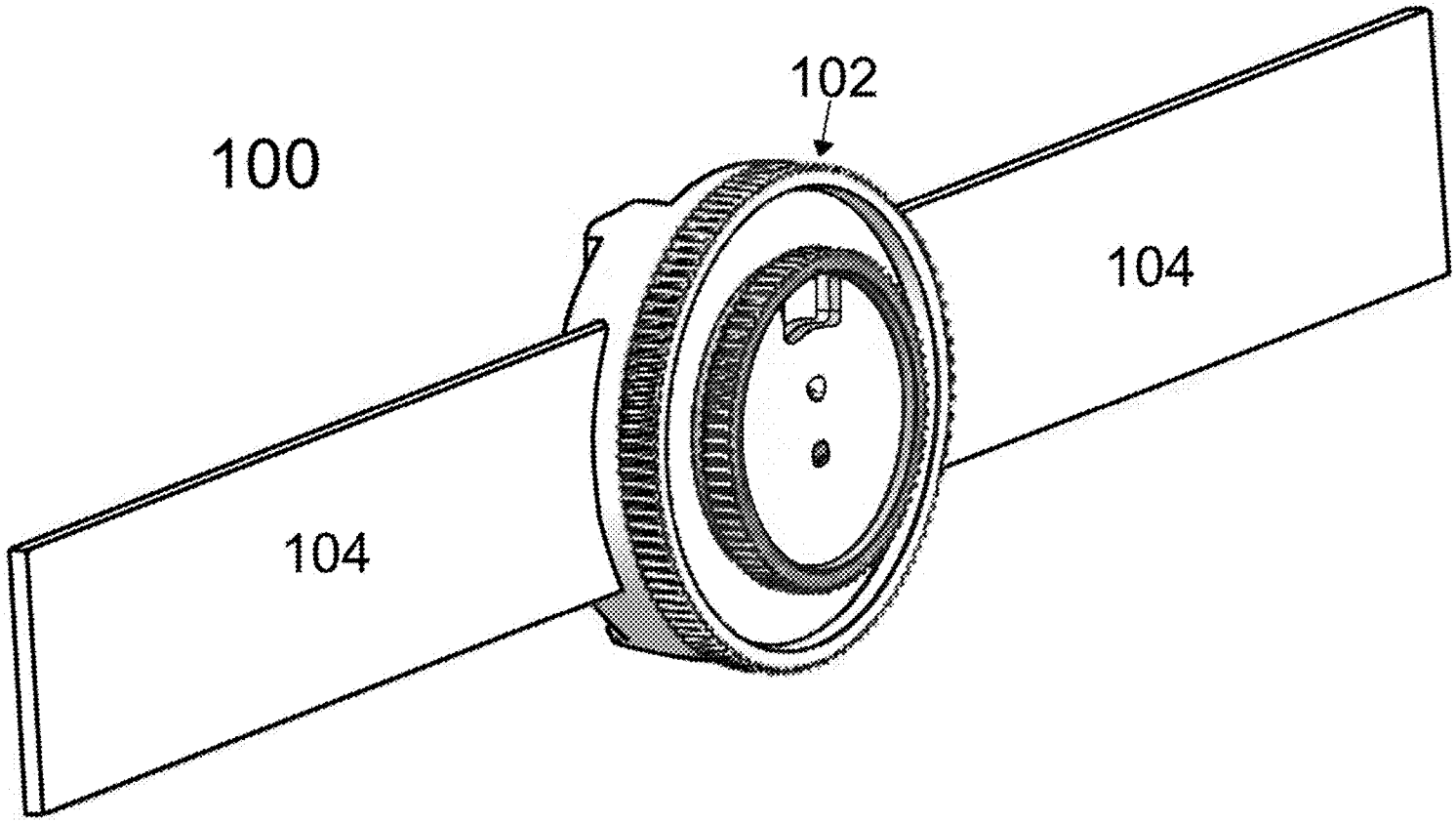
FIG. 1 is a front perspective of a pill reminder mechanism.

The present invention will now be described by referencing the appended figures representing preferred embodiments. FIG. 1 depicts a front perspective of a pill reminder mechanism 100. The pill reminder mechanism 100 may comprise a reminder mechanism 102 and a strap 104 coupled to the reminder mechanism. In one embodiment, the strap 104 may be configured to be detachably coupled to a bottle. In one embodiment, the strap 104 being configured to detachably couple to the bottle comprises the strap going around the bottle and tightened at the reminder mechanism 102. In another embodiment, the strap 104 may be tightened with a tightening mechanism secured to the strap 104. One of ordinary skill in the art will appreciate that a plurality of tightening methods may tighten the strap 104 around the bottle.

Figure 2:
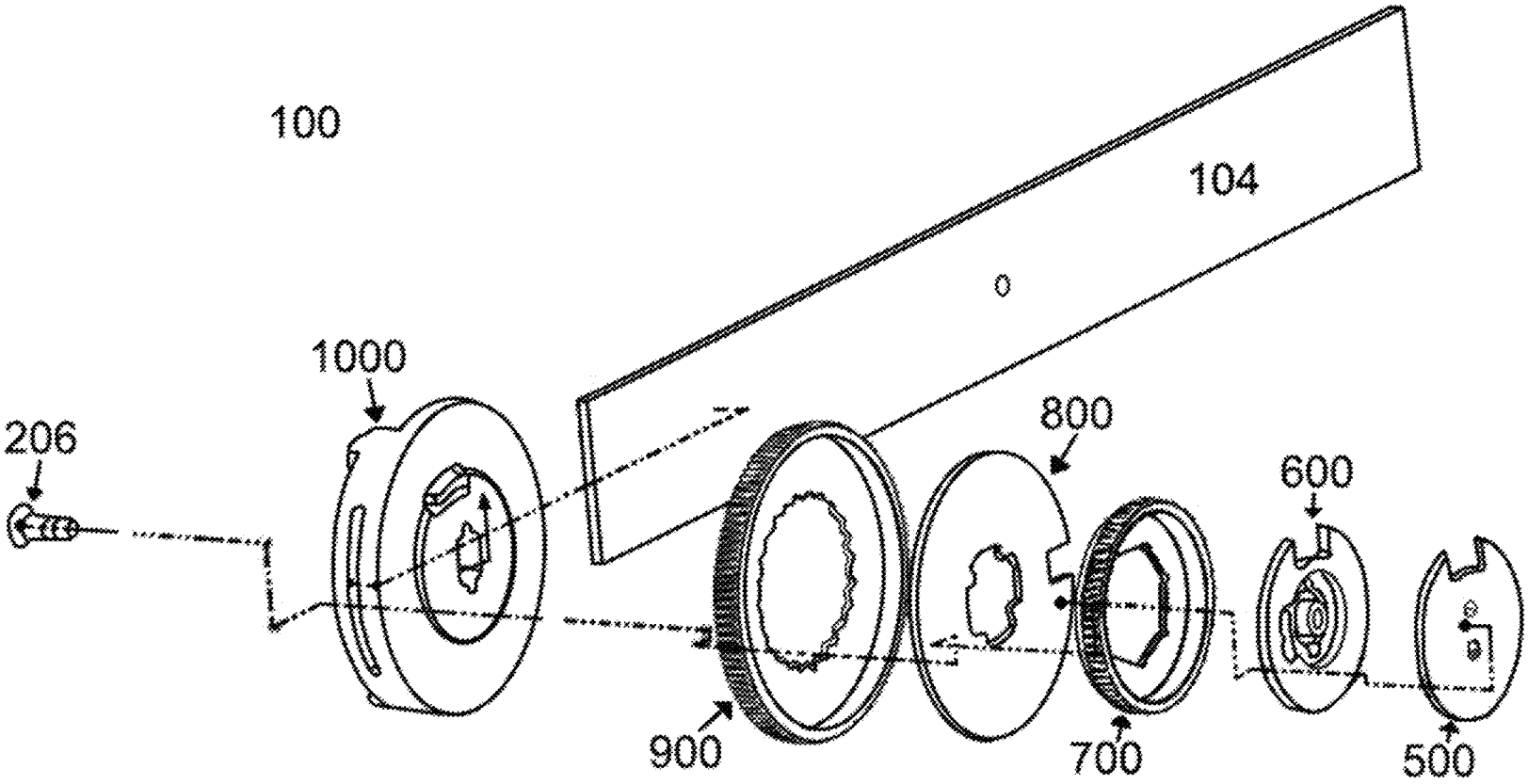
FIG. 2 is a front perspective of an exploded view of the pill reminder mechanism.

FIG. 2 depicts a front perspective of a dissected pill reminder mechanism 100. The pill reminder mechanism 100 may comprise a reminder mechanism 102 and a strap 104. The reminder mechanism may comprise a strap base 1000, a screw 206, an hour wheel 900, an hour face 800, a day wheel 700, a center hub 600, and a faceplate 500.

In one embodiment, the hour wheel 900 may be rotatably coupled to the strap base 1000. The hour face 800 may be rotatably coupled to the hour wheel 900. The day wheel 700 may be rotatably coupled to the hour face 800. The center hub 600 may be rotatably coupled to the day wheel 700. The faceplate 500 may be coupled to the center hub 600. The center hub 600 may be coupled to the screw 206. In one embodiment, the center hub 600 being coupled to the screw 206 may contain the strap base 1000, the hour face 800, and the day wheel 700 in the reminder mechanism. In another embodiment, the screw 206 may be coupled to the faceplate 500.

One of ordinary skill in the art will appreciate that the screw may be coupled to the center hub 600 at a tightness level that allows all components of the reminder mechanism to rotate about themselves. One of ordinary skill in the art will also appreciate that other coupling methods may secure the reminder mechanism in a similar manner to the screw 206.

Figure 3:
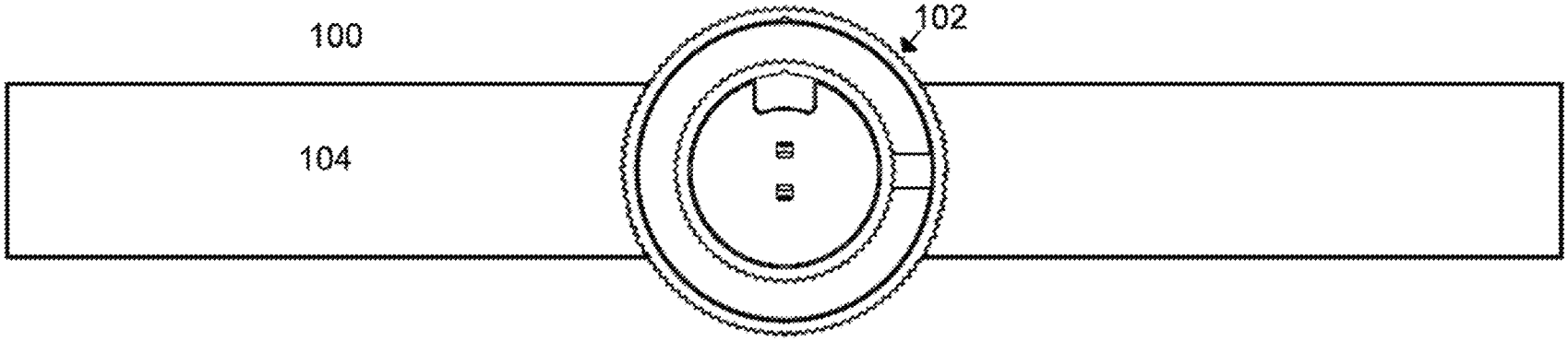
FIG. 3 is a front view of a pill reminder mechanism.

FIG. 3 depicts a front perspective of a pill reminder mechanism 100. The pill reminder mechanism 100 may comprise a reminder mechanism 102 and a strap 1304.

Figure 4:
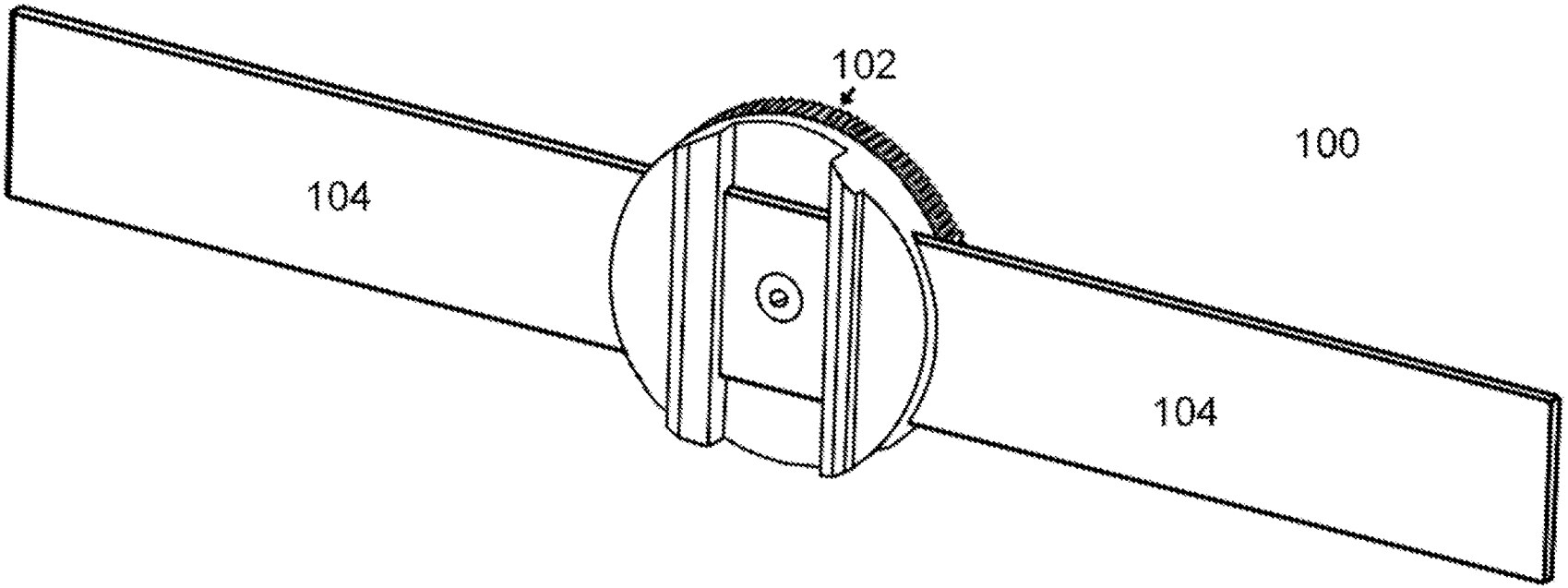
FIG. 4 is a back perspective of a pill reminder mechanism.

FIG. 4 depicts a back perspective of a pill reminder mechanism 100. The pill reminder mechanism 100 may comprise a reminder mechanism 102 and a strap 104.

In one embodiment, the strap 104 may thread two openings on a back side of the strap base 1000.

Figure 5:
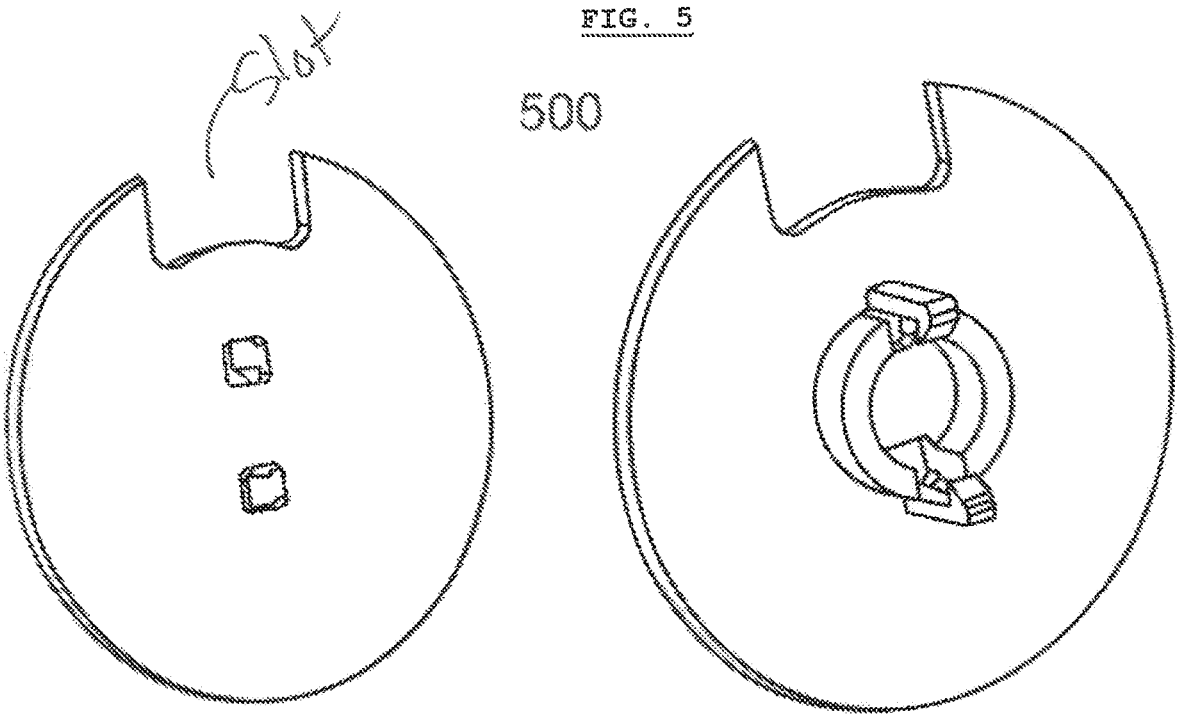
FIG. 5 is a perspective view of a front and back of a faceplate.

FIG. 5 depicts a perspective view of a front and back of a faceplate 500. In one embodiment, the faceplate 500 may be coupled to a center hub by clipping it onto the center hub. In one embodiment, and outer surface of the faceplate 500 may comprise decorative designs.

Figure 6:
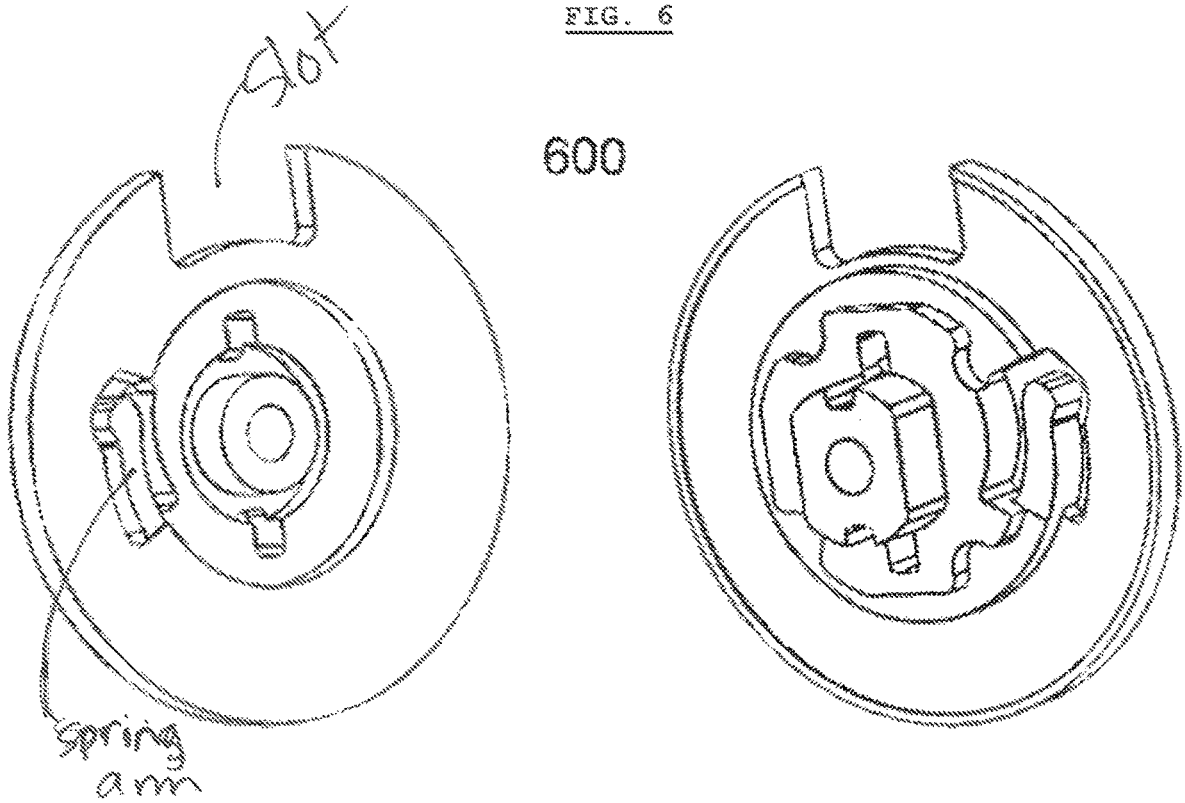
FIG. 6 is a perspective view of a front and back of a center hub.

FIG. 6 depicts a perspective view of a front and back of a center hub 600.

Figure 7:
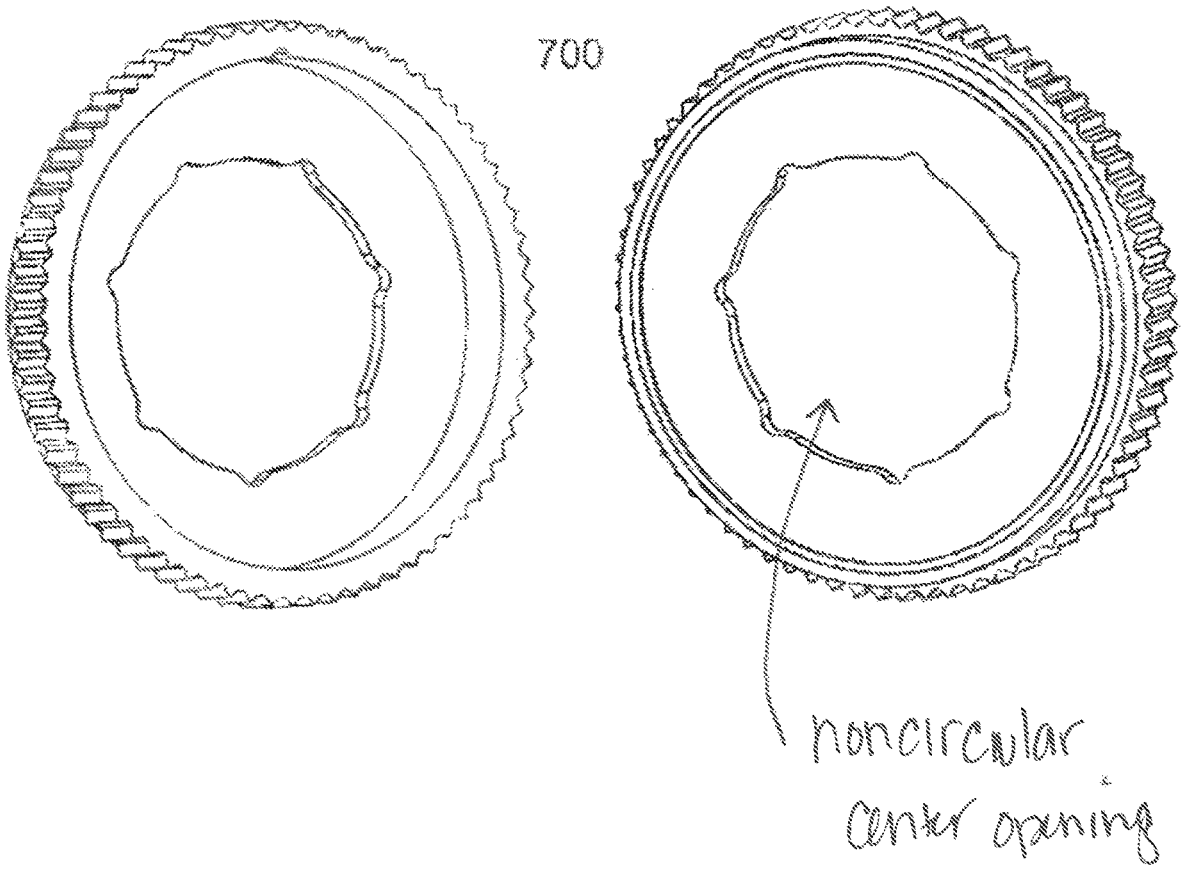
FIG. 7 is a perspective view of a front and back of a day wheel.

FIG. 7 depicts a perspective view of a front and back of a day wheel 700.

Figure 8:
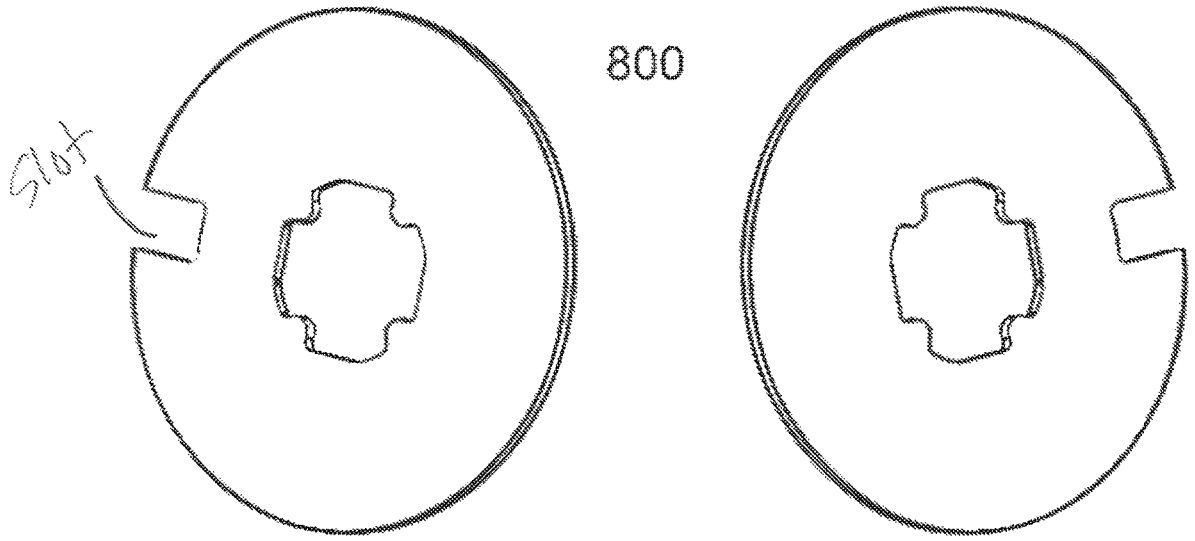
FIG. 8 is a perspective view of a front and back of an hour face.

FIG. 8 depicts a perspective view of a front and back of an hour face 800.

Figure 9:
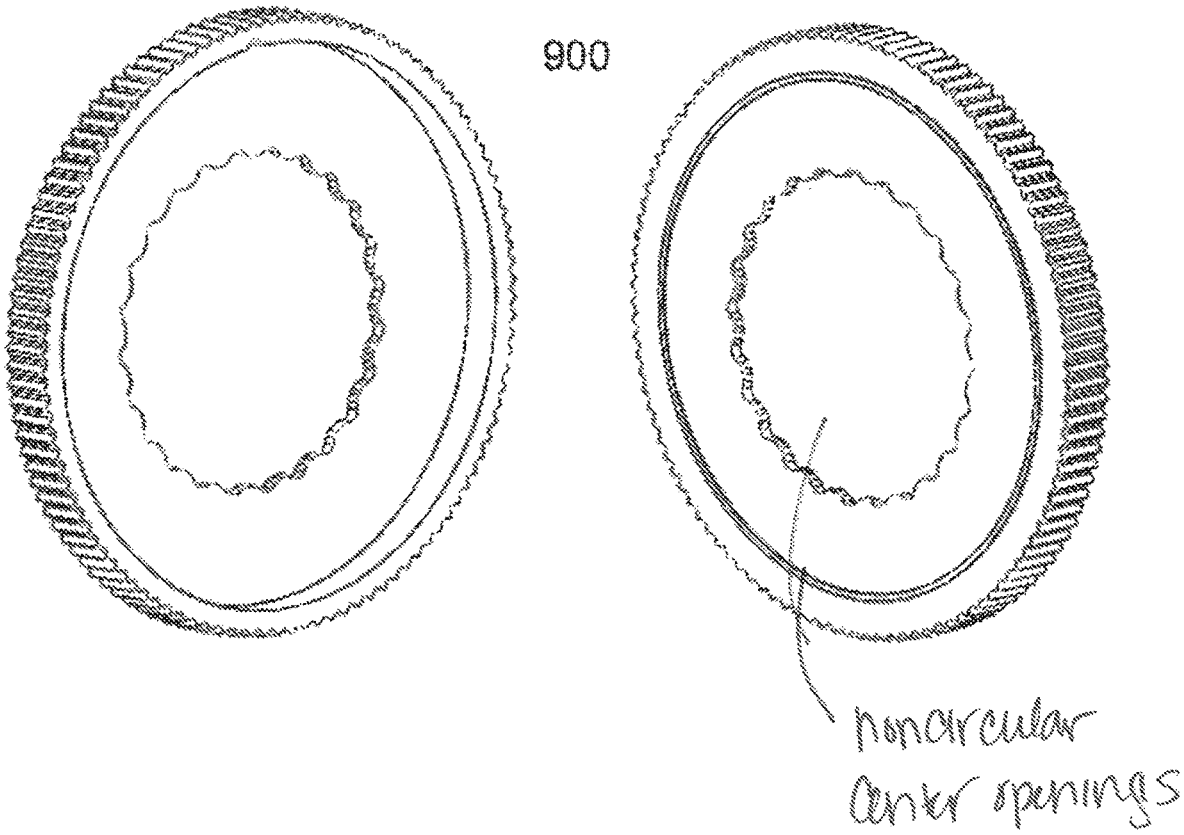
FIG. 9 is a perspective view of a front and back of an hour wheel.

FIG. 9 depicts a perspective view of a front and back of an hour wheel 900.

Figure 10:
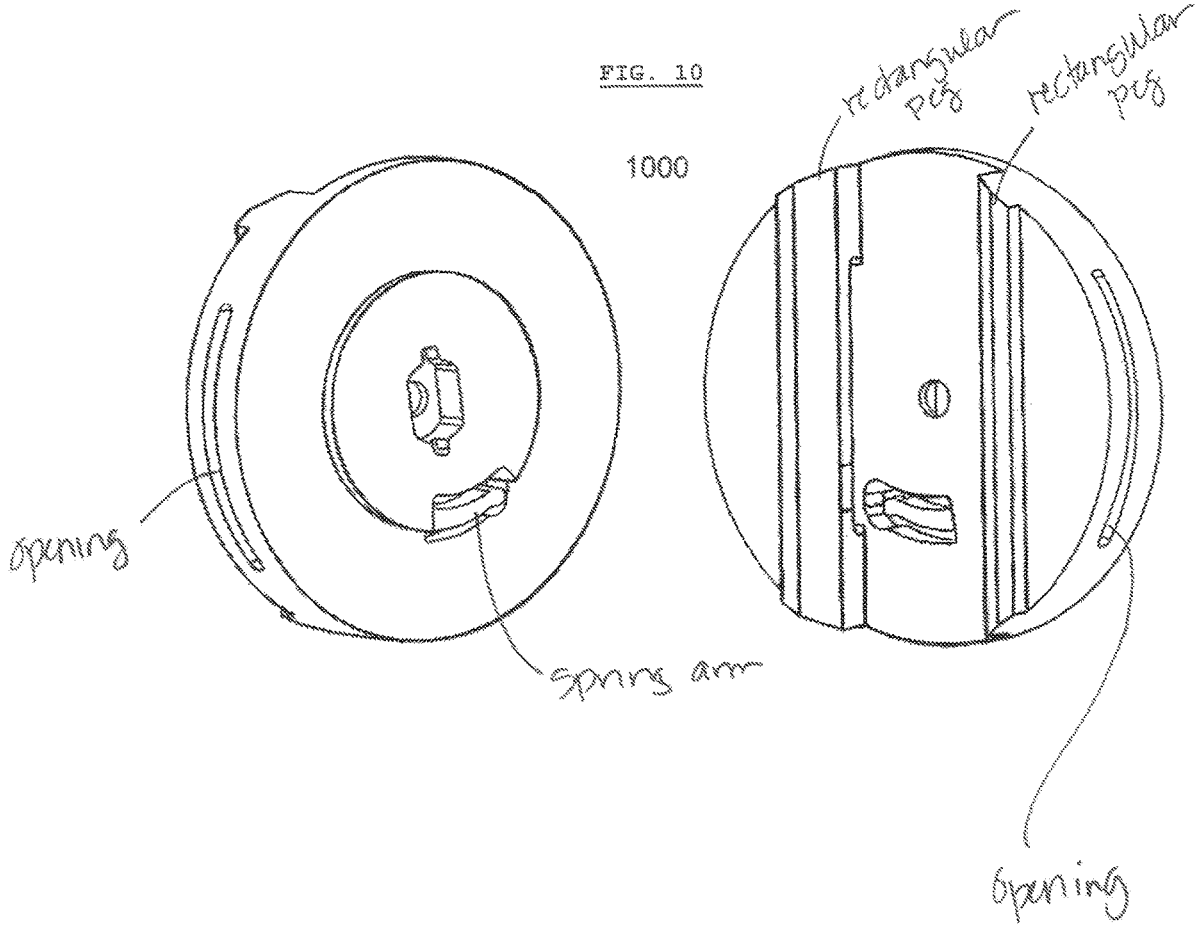
FIG. 10 is a perspective view of a front and back of a strap base.

FIG. 10 depicts a perspective view of a front and back of a strap base 1000.

In one embodiment, the reminder mechanism may comprise further dials that assist the operator in reminders related to regular taking of a substance such as, but not limited, medicine.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

A legend of components discussed herein follows:

Pill Reminder Mechanism 100
Reminder Mechanism 102
Strap 104
Faceplate 500
Center Hub 600
Day Wheel 700
Hour Face 800
Hour Wheel 900
Strap Base 1000

The inventor claims:

1. A pill reminder mechanism comprising:

a strap base, a strap detachably connected to the strap base for encircling a bottle to retain the strap base on a bottle, a circular hour wheel positioned over a front face of the strap base and rotatable about a central axis of the strap base, a circular hour face positioned over a front face of the hour wheel and having a diameter that is less than a diameter of the circular hour wheel, a circular day wheel positioned over a front face of the hour face and rotatable about the central axis and the circular day wheel having a diameter that is less than the diameter of the diameter of the circular hour wheel, a circular center hub positioned over a front face of the circular day wheel and the circular center hub having a diameter that is less than the diameter of the circular day wheel, a circular faceplate positioned over the front face of the circular center hub having a diameter that is less than the diameter of the circular day wheel, and a screw positioned along the central axis configured to cause the strap base, the circular hour wheel, the circular hour face, the circular day wheel, the circular center hub and the circular faceplate to be secured in position with respect to one another;

wherein the strap base includes a plurality of openings configured to receive the strap;

wherein each of the circular hour face, the circular center hub, and the circular faceplate includes a slot on an outer side edge thereof; and wherein the circular hour wheel has a front cavity that is sized to fully receive the circular hour face and a portion of the circular day wheel, and the circular day wheel has a front cavity that is sized to fully receive the circular center hub and circular faceplate when the pill reminder mechanism is fully assembled.

2. The pill reminder mechanism as defined in claim 1, wherein the strap base has two parallel rectangular pegs protruding from a rear face of the strap base opposite the front face of the strap base.

3. The pill reminder mechanism as defined in claim 1, wherein both the circular day wheel and circular hour wheel have non-circular central opening, both the strap base and the circular center hub comprise a spring arm, which engages the non-circular central openings of the circular day wheel and circular hour wheel.

* * * * *